US005647256A

United States Patent [19]

Schneider

[11] Patent Number: 5,647,256

[45] Date of Patent: Jul. 15, 1997

[54] PUNCH UNIT INCLUDING AN ADJUSTABLE PUNCH

[75] Inventor: Albrecht Schneider, Oberursel, Germany

[73] Assignee: Mate Precision Tooling Inc., Ramsey, Minn.

[21] Appl. No.: 471,189

[22] Filed: Jun. 6, 1995

[30] Foreign Application Priority Data

Feb. 20, 1995 [DE] Germany ..... 195 05 754.6

[51] Int. Cl.[6] ..... B26D 7/26; B26F 1/14

[52] U.S. Cl. ..... 83/140; 83/588; 83/686; 83/698.91; 83/699.41

[58] Field of Search ..... 83/140, 138, 139, 83/141, 527, 530, 698.91, 699.31, 699.41, 699.51, 699.61, 136, 142, 143, 640, 588, 684, 686

[56] References Cited

U.S. PATENT DOCUMENTS

| | | | |
|---|---|---|---|
| 2,172,272 | 9/1939 | Booth . | |
| 3,079,824 | 3/1963 | Schott | 83/698.91 X |
| 3,335,627 | 8/1967 | Smelts | 83/698.91 X |
| 3,871,254 | 3/1975 | Whistler, Jr. et al. . | |
| 3,935,771 | 2/1976 | Cady, Jr. | 83/140 |
| 3,935,772 | 2/1976 | Demus et al. . | |
| 3,958,476 | 5/1976 | Bartha . | |
| 4,092,888 | 6/1978 | Wilson . | |
| 4,166,403 | 9/1979 | DiDonato, Jr. et al. . | |
| 4,375,774 | 3/1983 | Wilson et al. | 83/140 |
| 4,440,052 | 4/1984 | Weisbeck | 83/140 |
| 4,457,196 | 7/1984 | Cady | 83/699.41 X |
| 4,691,602 | 9/1987 | Schlueter . | |
| 4,989,484 | 2/1991 | Johnson et al. . | |
| 5,054,347 | 10/1991 | Johnson et al. . | |
| 5,056,392 | 10/1991 | Johnson et al. . | |
| 5,081,891 | 1/1992 | Johnson et al. . | |
| 5,131,303 | 7/1992 | Wilson et al. | 83/140 |
| 5,176,057 | 1/1993 | Chun et al. . | |
| 5,271,303 | 12/1993 | Chatham | 83/140 X |
| 5,301,580 | 4/1994 | Rosene et al. | 83/140 X |
| 5,329,835 | 7/1994 | Timp et al. | 83/686 |
| 5,419,225 | 5/1995 | Fujita . | |
| 5,445,057 | 8/1995 | Fujita | 83/140 |

FOREIGN PATENT DOCUMENTS

| | | | |
|---|---|---|---|
| 0 000 762 | 2/1979 | European Pat. Off. . | |
| 1414343 | 9/1965 | France . | |
| 2 124 788 | 9/1972 | Germany . | |
| 6-551 | 1/1994 | Japan | 83/684 |
| 615382 | 1/1994 | Japan . | |
| 6226373 | 8/1994 | Japan . | |
| 2 050 910 | 1/1981 | United Kingdom . | |
| 94/07663 | 4/1994 | WIPO . | |

*Primary Examiner*—Rinaldi I. Rada
*Assistant Examiner*—Clark F. Dexter
*Attorney, Agent, or Firm*—Larson and Taylor

[57] ABSTRACT

The punch unit is comprised of a punch driver connected with a punch and has a base at its rear end. Securing members keep the punch and the punch driver free of relative rotation during the stroke of the punch. A pre-loaded compression spring can be compressed between the base and a guide bushing receiving the punch, so that it cannot be rotated during the stroke of the punch, but is axially displaceable. To make possible an adjustment of the total length of the punch in arbitrarily small steps, without weakening the connection between the punch and the punch driver, it is provided that the back end of the pressure spring is supported on a spring seat at the rear end of a sliding bushing which is maintained in the guide bushing and is axially displaceable with respect thereto, and that at least the rear part of the punch driver is connected indirectly or directly with the punch via an adjustment screw thread and is in engagement with the sliding bushing in a manner secure against relative rotation by means of releasable securing members.

7 Claims, 2 Drawing Sheets

PUNCH UNIT INCLUDING AN ADJUSTABLE PUNCH

FIELD OF THE INVENTION

The invention relates to a punch unit, comprising a punch driver connected with a punch which punch driver has a base at its back end, securing members, which keep the punch and the punch driver free of relative rotation during the stroke of the punch, and a pre-loaded pressure spring which, during the stroke of the punch, can be compressed between the base and a guide bushing receiving the punch so that it cannot be rotated, but is axially displaceable.

BACKGROUND OF THE INVENTION

A punch unit of this type is known from U.S. Pat. No. 5,131,303. In this structure, the back end of the punch, which is provided with an exterior screw thread, is screwed into a threaded bore at the front end of the punch driver. The threaded section at the back end of the punch is provided with four axial, longitudinal grooves, and an open spring washer, whose one end is radially bent inward and projects through a radial hole into one of the axial grooves of the punch, is seated on the exterior circumference of the front end of the punch driver. In the assembled state the guide bushing is frictionally connected via an O-ring with a washer seated on the punch driver underneath the pressure spring and prevents the spring washer from being able to yield radially outward. In this way the punch and the punch driver are directly connected with each other by the spring washer without being able to rotate.

When the punch is to be reground, the punch driver can be pulled away from the guide bushing toward the rear, in the course of which the frictional connection at the O-ring is released. After the spring washer has left the guide bushing, the threaded connection between the punch and the punch driver can be released by relative rotation. Because the radially inward bent end of the open spring washer has a point and the lateral walls of the grooves are inclined, the free end of the spring washer is pushed out of the groove in which it had been engaged, when the punch is rotated in relation to the punch driver and, with continued relative rotation, then engages the next groove. Knowing the thread pitch, it is also known which change in the total length of the punch and punch driver corresponds to the rotational angle between two grooves. Because of this it is possible in a very simple way to reset the total length of the punch and punch driver following the regrinding of the punch. As soon as the guide bushing has subsequently again been pushed over the open spring washer and has been frictionally connected with the punch driver via the O-ring, the screw connection between the punch and the punch driver is again dependably blocked against relative rotation because the guide bushing does not permit the open spring washer to widen radially, so that therefore its radially inwardly bent end no longer can leave the radial groove with which it is in engagement at that time.

Although the known punch unit assures a simple setting of the total length of the punch and punch driver, it suffers from the essential disadvantage that the grooves intended for securing against relative rotation weaken the screw thread through which the large punching forces are transmitted to the punch. This is of particular disadvantage in connection with punches having a relatively small cross section, as finer adjustment is required with decreasing cross section, because it is then necessary to have correspondingly more grooves at the circumference.

Furthermore, a punch unit of the type mentioned at the outset is on the market, wherein an upper and a lower punch driver element are connected by means of an adjustable screw thread, which can be secured in the respectively set relative position by means of two long safety screws, which can be unscrewed upwardly. A change of the total length of the punch driver is a very laborious process in this construction.

In another, also commercially available punch unit of this type, the upper and lower punch driver elements are secured by means of a central, axially displaceable bushing with teeth on the outside, which is maintained in an engagement secure against relative rotation with both elements of the punch driver by the action of a spring and which is disengaged from the upper punch driver element by an axial push against the spring force from above. However, in actual use it is very difficult to press down the thin-walled bushing, which is provided with an axial threaded bore, manually by means of a finger inserted into the screw thread, while simultaneously turning the upper punch driver element by the required amount.

SUMMARY OF THE INVENTION

It is therefore the object of the invention to provide a punch unit of the initially mentioned type wherein weakening of the connection between the punch and the punch driver is avoided and an adjustment of its total length becomes possible by a very simple manipulation in arbitrarily small steps.

The above object is attained in accordance with the invention in that the back end of the pressure spring is supported on a spring seat at the rear end of a sliding bushing, which is maintained in the guide bushing fixed against relative rotation, but is axially displaceable into a rear end position, and that at least the rear part of the punch driver is connected indirectly or directly with the punch via screw and is in engagement with the sliding bushing in a manner secure against relative rotation by means of releasable securing members.

The essential advantage achieved by means of the invention is that the securing members necessary for adjustably securing against relative rotation are disposed on a part which is not affected by the punching forces, namely the sliding bushing or the spring seat connected therewith, whose weakening is of no importance. At the same time the further advantage is achieved that with the same punch cross section the grooves are located on a larger radius. In this way it is easily possible to dispose more grooves, whose angular accuracy is greater, on the circumference.

In view of the simplicity and the costs of the punch unit, another advantage consists in that no or only small changes need to be made on the punch itself, which is a wearing part, for achieving the adjustable security against relative rotation between the punch and the punch driver, which is now assured in accordance with the invention indirectly via the sliding bushing. It is therefore not necessary to provide each replacement punch with grooves again because, when the punch is replaced, this portion of the security against relative rotation is maintained by means of the sliding bushing.

Beyond this, the invention offers increased functional dependability. With the known punch installation already mentioned at the outset it was possible that it could go unnoticed that the spring washer constituting the security against relative rotation was not correctly seated in the locked position. As a consequence the loading forces of the punch led to the destruction of the tool. However, with the proposed punch unit no damage can occur even if the releasable securing members are not in correct engagement, and this for the reason that the security against relative rotation acts between parts between which no punching forces are transmitted.

In a preferred embodiment of the invention, the punch driver consists of a front element, fixedly connected with the punch, and a rear element, which is in engagement therewith via the adjustment thread which, with an outer screw thread, can be screwed into an inner screw thread of the punch driver, for example. The latter can be clamped in a manner known per se to the punch by means of a screw and can be maintained fixed against relative rotation by means of a guide wedge in respect to the punch and the guide bushing. This embodiment of the punch unit permits a rapid and simple assembly and disassembly.

In a further preferred embodiment of the invention the spring seat is connected with the sliding bushing via a screw thread and can be fastened on it fixed against relative rotation after setting the spring pre-load. The advantage of this construction consists in that a single, simple component fulfills three functions, namely that of a spring seat, additionally that of a spring tensioner and finally that of a securing member for securing against relative rotation. In the last mentioned function the spring seat preferably cooperates with at least one securing member in the form of a resiliently pre-loaded pushbutton accessible from the exterior which, in the locked position, engages one of several recesses distributed over the circumference of the spring seat and which can be manually pushed out of the recess against the spring force.

To prevent the rear punch driver element from being pulled or screwed out of the sliding bushing, a safety ring, whose exterior diameter is greater than the interior diameter of the spring seat, is preferably seated on the rear portion of the punch driver directly in front of the spring seat.

An exemplary embodiment of the invention will be explained in detail below by means of the attached drawings.

BRIEF DESCRIPTION OF THE DRAWINGS

There follows a detailed description of the preferred embodiments of the present invention which are to be taken together with the accompanying drawings, wherein.

DETAILED DESCRIPTION OF THE PREFERRED EMBODIMENT

Figure 1:
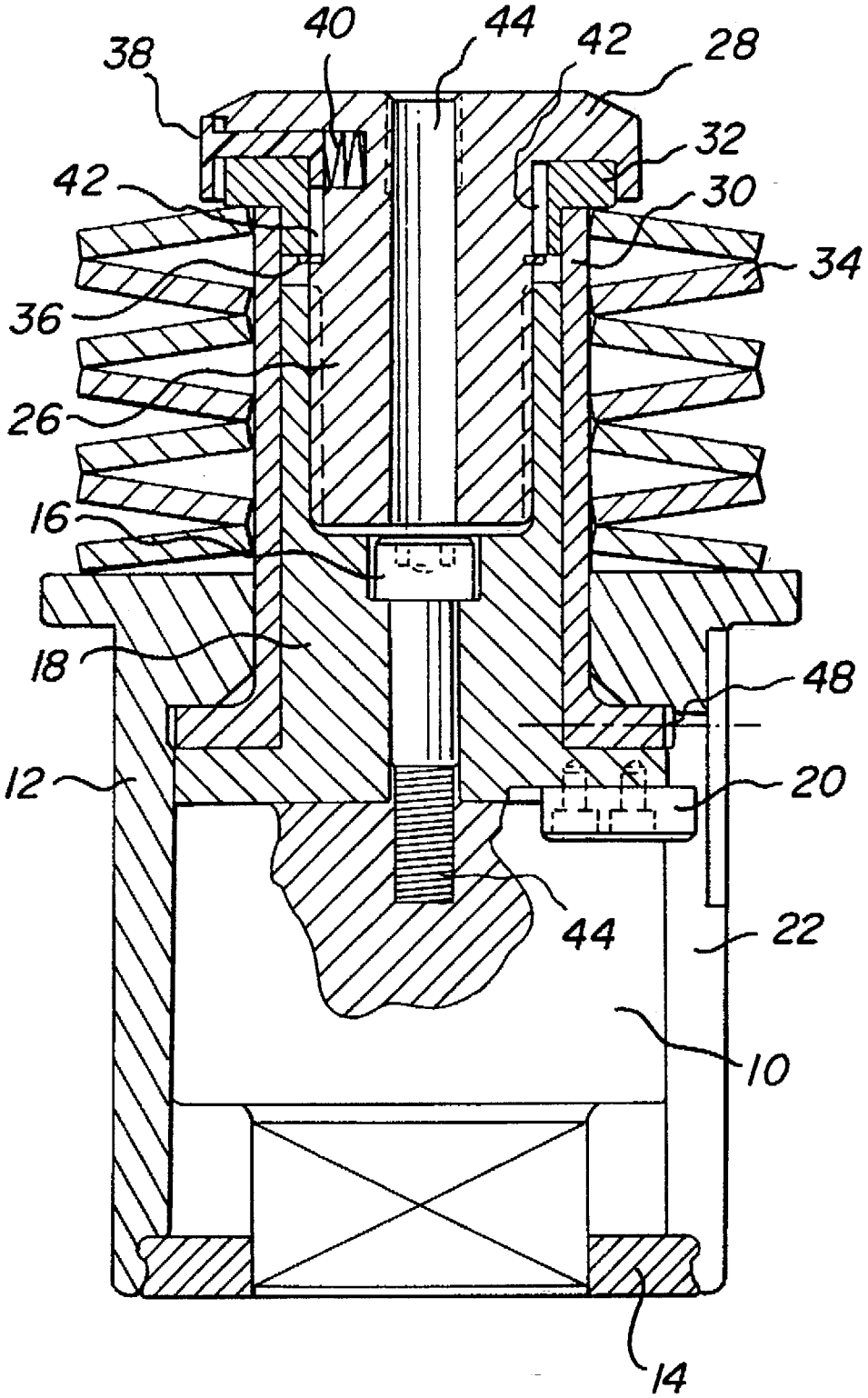
FIG. 1 is an axial longitudinal section through a punch unit in accordance with the invention in a state where the punch still has its original length.

Referring now to the figures, like elements are represented by like numerals throughout the several views.

In the punch unit shown, a punch 10 is guided, axially displaceable, in a guide bushing 12 which receives it. The guide bushing 12 is fastened on a machine frame, not shown, for example by screws. In an also conventional manner, a stripper plate 14 is releasably seated in the front or lower end of the guide bushing 12, whose job it is to strip the stamped workpieces from the front end of the punch 10 during punching.

The rear or upper end of the punch 10 is fixedly connected by means of an axial fastening screw 16 with the lower element 18 of a two-piece punch driver. This lower, or front punch driver element 18 is maintained, together with the punch 10, fixed against relative rotation by means of a spline, such as a guide key 20 mounted between the two, whose radially outer end engages an axial linear groove 22 in the guide bushing 12. The punching forces are transferred via the faces of the punch 10 and the lower punch driver element 18 which are clamped to each other by axial fastening screw 16 having screw threads 44.

The lower punch driver element 18 has a comparatively large and deep threaded bore 24 in its rear or upper area, into which the shaft of an upper, or rear punch driver element 26, provided with an exterior screw thread, can be screwed. The latter is designed with a radially projecting base 28 on its rear end.

The lower punch driver element 18 is axially displaceably guided in a sliding bushing 30, which in turn is guided in the rear area of the guide bushing 12. When the sliding bushing 30 is pulled toward the back, a flange-like widening formed on the front end of the sliding bushing 30 comes to rest against the rear or upper end wall of the guide bushing 12, by means of which the displacement travel toward the rear of the sliding bushing 30 is limited. The sliding bushing 30 is maintained fixed against relative rotation with respect to the guide bushing 12, the punch 10 and the lower punch driver element 18 by means which may include a linear groove (not shown) in the lower punch driver element 18 and/or in the sliding bushing 30, which groove cooperates with a groove-engaging projection (not shown) on the respective other part or on the rear end wall of the guide bushing 12. This means may comprise, for example, a guide pin secured to the sliding bushing 30 by a securing screw which is represented schematically in FIG. 1 by dot-dash line 48.

On its rear or upper end, the sliding bushing 30 is provided with an interior screw thread into which a collar-shaped part of a ring-shaped spring seat 32, embodied with an exterior screw thread, can be screwed. It projects radially outward beyond the exterior circumference of the sliding bushing 30 and forms a support or a spring seat for a compression spring 34 which, in the case of the example, has the shape of several disk springs arranged in series. The compression spring 34 is clamped between the rear end wall of the sliding bushing 12 and the spring seat 32. Spring pre-load can be adjusted by turning the spring seat 32 in relation to the sliding bushing 30. Afterwards the spring seat 32 is fastened on the sliding bushing 30, fixed against relative rotation, by means of a securing screw, adhesive or other suitable means. In the assembled state a securing ring 36, for example a snap ring, whose exterior diameter is greater than the interior diameter of the spring seat 32, is seated in a ring-shaped groove in the exterior circumferential surface of the upper punch driver element 26 directly below the collar-shaped part of the spring seat 32. It prevents the upper punch driver element 26 from being screwed or pulled out of the sliding bushing 30 toward the back.

Figure 2:
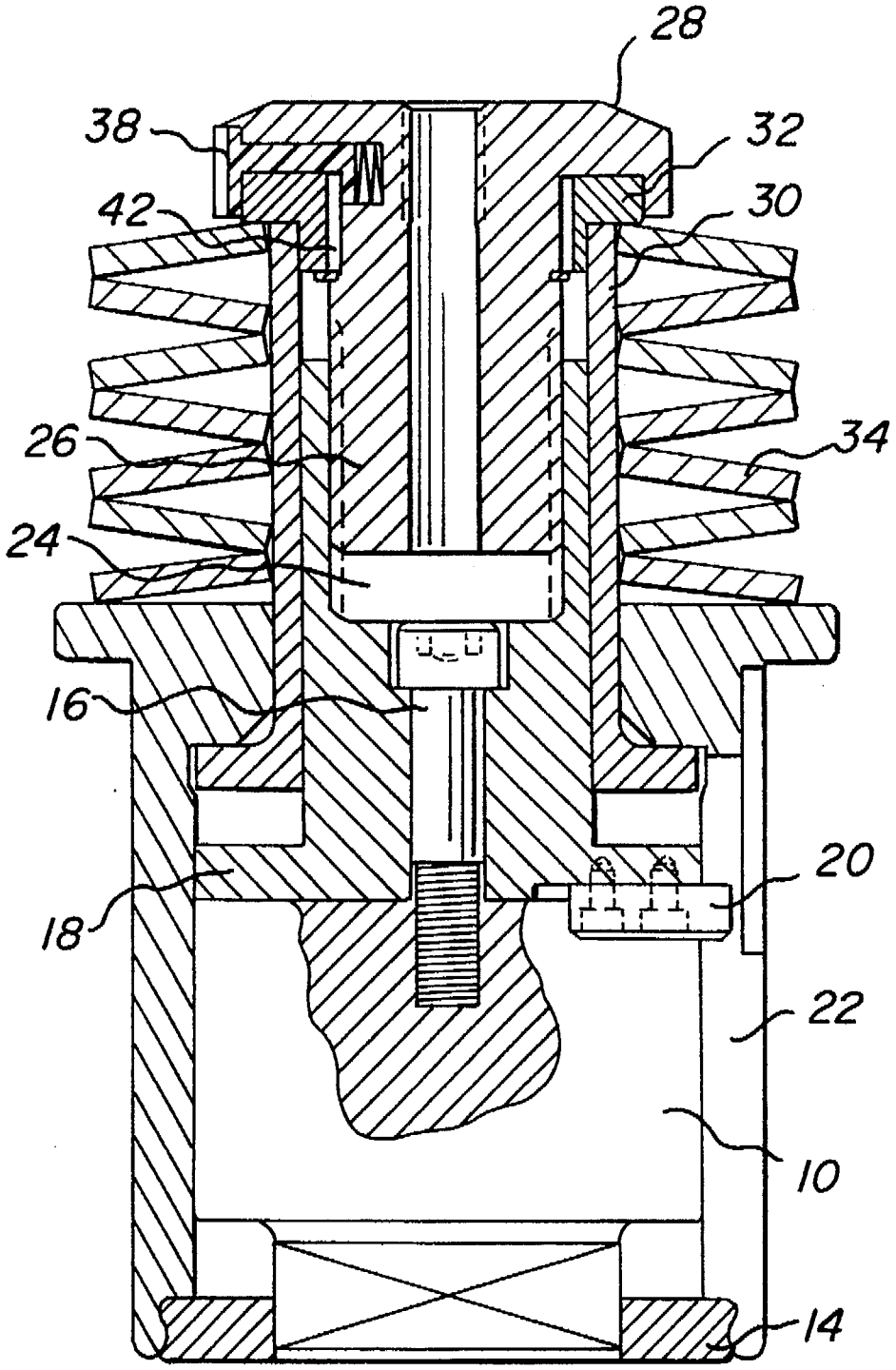
FIG. 2 is a further longitudinal section through the punch unit corresponding to FIG. 1 following regrinding and shortening of the punch caused by this.

In the exemplary embodiment, the radially projecting base 28 of the punch driver 18, 26, overlaps the spring seat 32 and has on its underside a radially extending recess in which a releasable securing member, pushbutton 38, which is accessible on the circumferential face of the punch driver base 28, is radially guided. It is acted upon by a pressure spring 40 inserted into the recess of the punch driver base 28 and having the tendency to press the pushbutton 38 radially outward into a locking position, in which a projection on the pushbutton 38, which is oriented axially with respect to the longitudinal axis of the punch, engages an interior linear groove 42 in the spring seat 32. An arbitrary number, for example 4, 6 or 8, of linear grooves 42 evenly distributed over the circumference can be provided in the spring seat 32, and the axial projection on the pushbutton 38 can be selectively brought into engagement with each one. If the pushbutton 38 is pressed radially from the outside, its axial projection exits the linear groove 42 in the spring seat 32 radially toward the interior, as represented in FIG. 2, and the upper punch driver element 26 can be screwed out in relation to the sliding bushing 30 and the spring seat 32.

The upper punch driver element 26 is provided with a central axial bore 44, which is aligned with the fastening screw 16 connecting the punch 10 with the lower punch driver element 18. The bore 44 has been selected to be sufficiently large to make it possible make it possible to reach the hexagon socket in the rear end face of the screw 16 through this bore 44 with a screw tool. The rear end of the bore 44 is provided with a screw thread to make it possible to screw in a support bolt from which the punch unit can be suspended for lifting and transporting it.

To disassemble the punch unit, the pushbutton 38 is radially pressed in and then the base 28 of the upper punch driver element 26 is turned in the direction in which the lower punch driver unit 18 is rotated off the upper punch driver element 26 toward the bottom or the front. After removal of the stripper plate 14 it is then possible to pull the punch 10 and the lower punch driver element 18 out of the sliding bushing 30 downward or toward the front. During the turning movement the securing ring 36 prevents the upper punch driver element 26 from exiting the sliding bushing 30 toward the top. The remaining parts of the punch unit can be taken apart after the securing or arresting between the spring seat 32 and the sliding bushing 30 have been released and the securing ring 36 has been taken off.

If only the punch 10, but not the lower punch driver element 18 is to be removed, it is possible to unscrew the screw 16, which is seated in a through-bore of the lower punch driver element and is screwed into a threaded bore in the punch 10, through the bore 44 by means of a screwing tool from the punch.

Reassembly of the punch 10 or of the unit of the punch 10 and the lower punch driver element 18 held together by the screw 16 takes place, respectively, in the reverse sequence from the previously described disassembly. If only the punch 10 has been removed for regrinding, it is possible to compensate for its shortening very easily and simply after reassembly in that the axial relative position between the upper punch driver element 26 and the lower punch driver element 18 is changed, with the pushbutton 38 depressed, by turning the base 28 of the upper punch driver element 26 until the lower edge of the punch, which is visible from the outside, has attained the correct position in relation to the stripper plate. With the pitch of the threads between the upper punch driver element 26 and the lower punch driver element 18 known, it is also known by how many divisions of the linear grooves 42 the upper punch driver element 26 must be turned to compensate the shortening of the punch 10. If the axial projection on the pushbutton 38 is then again allowed to enter one of the linear grooves 42 in the spring seat 32, all parts are locked against turning.

It is understood that the individual elements of the punch unit can have shapes different from the ones shown. In place of locking by means of either one pushbutton 38 or also by means of two pushbuttons 38 located diametrically opposed, it is possible in individual cases to employ a locking mechanism having, for example, a plurality of spring-loaded spheres for securing a defined relative position of angular rotation between the upper punch driver element 26 and the spring seat 32. This locking mechanism must be adjusted in such a way that it can be overcome by a defined torque exerted on the base 28 of the upper punch driver element 26. Further than that it would also be possible to embody the punch driver 18, 26 as a single piece and to connect it with the punch 10 via an adjusting screw thread.

Although the invention has been described in considerable detail with respect to preferred embodiments thereof, variations and modifications will be apparent to those skilled in the art without departing from the spirit and scope of the invention as set forth in the claims.

What is claimed is:

1. A punch unit comprising:

a punch driver having front and rear ends, said rear end having a base thereon;

a punch connected to said front end of said punch driver by means of an axial fastening screw;

a guide bushing slidably receiving said punch and guiding axial displacement of said punch, said guide bushing including means for preventing rotation of said punch relative to said guide bushing during a stroke of said punch;

a sliding bushing having front and rear ends and receiving said punch driver, said front end of the sliding bushing being axially displaceably guided in said guide bushing;

a compression spring maintained under pre-load between said base and said guide bushing, said compression spring being compressible between said base and said guide bushing during a stroke of said punch;

a spring seat positioned between said rear end of said sliding bushing and said base and fastened to said sliding bushing, said compression spring being supported on said spring seat; and at least one releasable securing member movably mounted on at least one of said punch driver and said spring seat such that it is engageable with the other of said punch driver and said spring seat, said releasable securing member being movable between a locked position, wherein said securing member engages the other of said punch driver and said spring seat to prevent relative rotation of at least part of said punch driver and said sliding bushing during a stroke of said punch, and an unlocked position for allowing relative rotation of said punch driver and said sliding bushing.

2. The punch unit according to claim 1 wherein said punch driver comprises a front element fixedly connected with said punch and a rear element engaged with the front element.

3. The punch unit according to claim 2 wherein said front and rear elements are connected by means of an exterior screw thread on said rear element engageable with an interior screw thread in said front element.

4. The punch unit according to claim 2 wherein said front element is connected with said punch by means of said axial fastening screw and said means for preventing rotation of said punch relative to said guide bushing comprises a spline interlocking the front element and the punch.

5. The punch unit according to claim 2 further comprising a securing ring seated on said rear element in front of said spring seat, an exterior diameter of said securing ring being greater than an interior diameter of said spring seat.

6. The punch unit according to claim 1 wherein said at least one securing member comprises a pushbutton on said base and said spring seat includes a plurality of recesses distributed over a circumference thereof, said pushbutton engaging one of said recesses in a locked state and being movable out of said recesses against a force of a pressure spring positioned in said base.

7. The punch unit according to claim 1 wherein a front end of said sliding bushing includes a flange-shaped widening and said rear end of said guide bushing includes an inwardly extending shoulder having an inner diameter which is smaller than an outer diameter of said flange-shaped widening, for limiting axial displacement of said sliding bushing.

* * * * *